United States Patent [19]

Tosaka et al.

[11] Patent Number: 4,670,368

[45] Date of Patent: Jun. 2, 1987

[54] MAGNETIC DEVELOPER FOR DEVELOPING LATENT ELECTROSTATIC IMAGES

[75] Inventors: Hachiro Tosaka, Shizuoka; Kimitoshi Yamaguchi; Motoi Orihara, both of Numazu, all of Japan

[73] Assignee: Ricoh Company, Ltd., Tokyo, Japan

[21] Appl. No.: 824,082

[22] Filed: Jan. 30, 1986

[30] Foreign Application Priority Data

Feb. 6, 1985 [JP] Japan ..... 60-020078

[51] Int. Cl.[4] ..... G03G 9/14

[52] U.S. Cl. ..... 430/106.6

[58] Field of Search ..... 430/106.6

[56] References Cited

FOREIGN PATENT DOCUMENTS 0053492 6/1982 European Pat. Off. ..... 430/106.6

56-16145 2/1981 Japan ..... 430/106.6

2074745 11/1981 Japan ..... 430/106.6

*Primary Examiner*—Roland E. Martin

*Attorney, Agent, or Firm*—Oblon, Fisher, Spivak, McClelland & Maier

[57] ABSTRACT

A developer comprises a mixture of (a) magnetic toner particles comprising a polymeric material and finely-divided magnetic particles, having an electric resistivity of $10^{12}$ Ωcm or more, and (b) electroconductive magnetic particles having an electric resistivity of $10^{9}$ Ωcm or less, a smaller volume mean diameter than that of the magnetic toner particles, with the saturation magnetic moment of the electroconductive magnetic particles being in the range of from 25 emu/g to 75 emu/g, which is larger than the saturation magnetic moment of the magnetic toner particles.

10 Claims, 3 Drawing Figures

MAGNETIC DEVELOPER FOR DEVELOPING LATENT ELECTROSTATIC IMAGES

BACKGROUND OF THE INVENTION

The present invention relates to a developer for developing latent electrostatic images, and more particularly to a developer comprising a mixture of (a) magnetic toner particles comprising a polymeric material and finely-divided magnetic particles, having high electric resistivity, and (b) electroconductive magnetic particles having a smaller volume mean diameter than that of the magnetic toner particles, with the saturation magnetic moment of the electroconductive magnetic particles being in the range of from 25 emu/g to 75 emu/g and larger than the saturation magnetic moment of the magnetic toner particles.

Conventionally, as a method of developing latent electrostatic images, there is known a one-component magnetic toner development method employing a one-component magnetic toner. In this method, a one-component magnetic toner, which is held on an electrically conductive, non-magnetic sleeve with an inner magnet held therein, is moved onto a latent electrostatic image formed on a latent-electroconductive-image-bearing member backed with an electrically conductive backing member. As a result, electrically conductive paths are formed between the electrically conductive backing member, the sleeve and the magnetic toner particles, so that electric charges having an opposite polarity to that of the latent electrostatic image are induced in the magnetic toner particles. In the end, the magnetic toner particles are attracted to the latent electrostatic images, so that the latent electrostatic image is developed to a visible toner image.

Such magnetic toner as employed in the above method is constructed in such a manner that the surfaces of the toner particles are more electrically conductive than the core portions of the toner particles, for example, as proposed in U.S. Pat. No. 3,639,245. Such magnetic toner, however, has the shortcoming that images developed by the toner are difficult to electrostatically transfer to transfer sheets. In other words, the image transfer performance of the magnetic toner is poor. However, if the electric resistivity of such magnetic toner is increased in order to eliminate such shortcoming, then the development performance is degraded.

In order to improve such a magnetic toner so as to make it excellent in both development performance and image transfer performance, the inventors of the present invention have previously proposed in Japanese Laid-Open Patent Application No. 56-142540 a developer comprising a mixture of (a) magnetic toner particles comprising finely-divided magnetic particles, having high electric resistivity, and (b) electroconductive magnetic particles having a smaller volume mean diameter than that of the magnetic toner particles. This developer is excellent in development performance and image transfer performance However, it has the shortcoming that the mixing ratio of the magnetic toner particles and the electroconductive magnetic particles is apt to change during the course of use over an extended period of time, because of the magnetic coagulation of the magnetic particles and uneven distribution of the coagulated magnetic particles in the developer, so that white undeveloped spots and band-like shaped areas are formed within the developed toner images.

SUMMARY OF THE INVENTION

It is therefore an object of the present invention to provide an improved developer for developing latent electrostatic images, which is of the same type as that of the developer propcsed in Japanese Laid-Open Patent Application No. 56-142540, but from which the above-mentioned shortcomings have been eliminated.

According to the present invention, this object is attained by a developer comprising a mixture of (a) magnetic toner particles comprising a polymeric material and finely-divided magnetic particles having high electric resistivity, and (b) electroconductive magnetic particles having a smaller volume mean diameter than that of the magnetic toner particles, with the saturation magnetic moment of the electroconductive magnetic particles being in the range of from 25 emu/g to 75 emu/g, which is larger than the saturation magnetic moment of the magnetic toner particles.

DETAILED DESCRIPTION OF THE PREFERRED EMBODIMENTS

By referring to FIGS. 1(A) and 1(B), the development process of latent electrostatic images using a developer according to the present invention will now be explained.

Figure 1A:
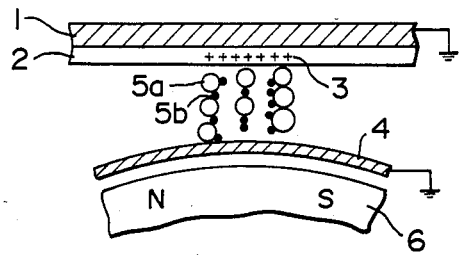
FIG. 1(A) is a schematic illustration in explanation of the development process of latent electrostatic images when a developer according to the present invention is employed.

FIG. 1(A) schematically shows the development of a latent electrostatic image 3 formed on a photoconductive or dielectric layer 2 which is backed with an electroconductive backing member 1. In the figure, a developer 5 comprising a mixture of magnetic toner particles 5*a* having high electric resistivity and electroconductive magnetic particles 5*b* is held on an electroconductive, non-magnetic sleeve 4 with an inner magnet 6 disposed within the sleeve 4. By the relative movement of the sleeve 4 to the inner magnet 6 or vice versa, the developer 5 held on the sleeve 4 is brought near or into contact with a latent electrostatic image. In this state, charges having an opposite polarity to that of the latent electrostatic images are induced in the electroconductive magnetic particles 5*b* by the sleeve 4, so that part of the induced charges is accumulated in the magnetic toner particles 5*a* which are present near the latent electrostatic image. As a result, the magnetic toner particles 5*a* and the electroconductive magnetic particles 5*b* are both attracted to the latent electrostatic image, so that the latent image is developed.

Figure 1B:
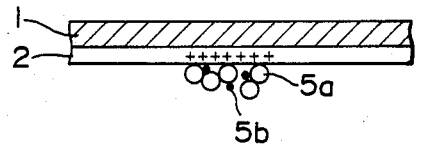
FIG. 1(B) is a schematic illustration of an image developed with the developer according to the present invention.

FIG. 1(B) schematically shows an image developed with the developer according to the present invention. As shown in the figure, the developed image consists of the magnetic toner particles 5*a* and the electroconductive magnetic particles 5*b*. From the comparison between the attraction force of the inner magnet 6 per unit weight thereof working on the magnetic toner particles 5*a* and the attraction force working on the electroconductive magnetic particles 5*a*, it has been confirmed that the electroconductive magnetic particles 5*b* are more attracted to the inner magnet 6 than the magnetic toner particles 5*a*, so that more magnetic toner particles 5*a* are deposited on the latent electrostatic image than the electroconductive magnetic particles 5*b*. The developed image shown in FIG. 1(B) is then superimposed on a transfer sheet such as a sheet of plain paper and is then electrostatically transferred thereto under application of corona charges. In this image transfer step, the magnetic toner particles 5*a* are more easily transferred to the transfer sheet than the electroconductive magnetic particles 5*b*. The magnetic particles 5*b* are dragged toward the transfer sheet by the relatively weak attraction between the magnetic toner particles 5*a* and the electroconductive magnetic particles 5*b*, so that part of the magnetic particles 5*b* is also transferred to the transfer sheet.

As mentioned previously, the developer according to the present invention comprises a mixture of (a) magnetic toner particles comprising finely-divided magnetic particles, having high electric resistivity, and (b) electroconductive magnetic particles having a smaller volume mean diameter than that of the magnetic toner particles, with the saturation magnetic moment of the electroconductive magnetic particles being in the range of from 25 emu/g to 75 emu/g, which is larger than the saturation magnetic moment of the magnetic toner particles.

In the present invention, in order to attain excellent development performance and excellent image transfer performance, it is necessary that the electroconductive magnetic particles 5*b* have a smaller volume mean diameter than that of the magnetic toner particles 5*a*. When the electroconductive magnetic particles 5*b* are larger in volume mean diameter than the magnetic toner particles 5*a*, the magnetic toner particles 5*a* cover the surfaces of the electroconductive magnetic particles 5*b*. As the particle sizes of the magnetic particles 5*b* increase, the magnetic attraction of the magnetic particles 5*b* toward the magnet 6 also increases. The result is that magnetic particles 5*b* covered with the magnetic toner particles 5*a* are attracted toward the magnet 6, with the image areas to be developed being partially remained undeveloped. The same thing happens in the course of image transfer since a lesser amount of electroconductive magnetic particles 5*b* are transferred to the transfer sheet than the magnetic toner particles 5*a*.

When the electroconductive magnetic particles 5*b* are much smaller in volume mean diameter than the magnetic toner particles 5*a*, the electroconductive magnetic particles are firmly attracted to the surfaces of the magnetic toner particles 5*a* by van der Waals' force. The result is that the magnetic toner particles 5*a* come to have a similar structure to that of the previously mentioned conventional one-component magnetic toner particles which are more electroconductive at the outer surface portions as compared with the core portions, so that the electrostatic image transfer performance becomes poor.

In the present invention, it is preferable that the volume mean diameter of the electroconductive magnetic particles be in the range of 1/5 to 4/5 the volume mean diameter of the magnetic toner particles, more preferably in the range of 3/10 to $\frac{2}{3}$. The volume mean diameters of these particles are measured by Coulter counter.

Furthermore, in the present invention, it is preferable that the volume resistivity of the electroconductive magnetic particles be $10^9$ Ωcm or less, and the volume resistivity of the magnetic toner particles be $10^{12}$ Ωcm or more.

The volume resistivities of these particles were measured by placing 1 ml of a sample of the electroconductive magnetic particles or magnetic toner particles in a cylindrical container consisting of an electroconductive flat bottom with an inner diameter of 20 mm, which served as an electrode, and a side wall made of an electrically insulating material. An electrode plate having a diameter of slightly less than 20 mm and a weight of 100 g was placed on the sample placed in the container. Under this condition, the sample was allowed to stand for 1 hour. A potential of 100 V was applied across the electroconductive flat bottom of the container and the electrode plate placed on the sample. 1 minute after the application of the voltage, the electric current which flowed through the sample was then measured, from which the volume resistivity of the sample was determined.

As the magnetic toner particles for use in the present invention, conventional toner particles can be employed so long as each toner particle comprises as the main components (a) a polymeric material and (b) finely-divided magnetic particles, when necessary with addition thereto of a colorant and a fluidity improvement agent.

Examples of such polymeric materials are styrene-type resin, acrylic resin, vinyl-type resin, epoxy resin, polyester resin, phenolic resin, polyurethane resin, natural resin and celluloses.

Examples of the finely-divided magnetic particles are magnetizable particles of metals, metal oxides and alloys of Fe, Ni, Co and Mn, having the particle sizes of 1 μm or less.

As the colorants, for example, carbon black, Aniline Black, Crystal Violet, Rhodamine B, Malachite Green, Nigrosin, copper phthalocyanines and azo dyes can be employed in the magnetic toner particles.

Furthermore, waxes, fatty acids, fatty acid metal salts, silica powder and zinc oxide powder can also be employed as additives to the magnetic toner particles.

In the present invention, it has been confirmed that a better image transfer efficiency can be obtained when the magnetic toner particles are formed so as to have a tendency of being triboelectrically charged with a polarity opposite to that of the charges applied to a transfer sheet during the electrostatic image transfer process. In order to attain this, it is preferable to add to the magnetic toner particles a polarity control agent such as Nigrosin, mono-azo dyes, zinc hexadecyl succinate, alkyl esters of naphthoic acid, alkylamides of naphthoic acid, nitrohumic acid, N,N'-tetramethyldiamine benzophenone, N, N'-tetrabenzidine, triazine and salicylic acid metal complexes.

In the present invention, it is preferable that the saturation magnetic moment of the electroconductive magnetic particles be in the range of from 25 emu/g to 75 emu/g, which is larger than the saturation magnetic moment of the magnetic toner particles. This is because the magnetic coagulation of the magnetic particles can be minimized under the above-mentioned condition. When the magnetic coagulation of the magnetic particles occurs, the magnetic particles become large in size, so that they are more attracted toward the magnet 6. As a result, the magnetic particles are not transferred to latent electrostatic images and non-developed band-like ehaped areas or white spots are formed in the images to be developed. When the coagulated magnetic particles become larger than the gap between a doctor blade and the sleeve 4, the gap may become clogged with the magnetic particles, or smooth passage of the magnetic particles through the gap is hindered, so that the developer cannot be sufficiently supplied onto the development sleeve for development of the latent electrostatic images. As a result, band-like shaped non-developed areas are formed in the images to be developed.

When the saturation magnetic moment of the magnetic particles is smaller than that of the magnetic toner particles, a larger amount of the magnetic particles is deposited on the latent electrostatic images than the magnetic toner particles. However, since the deposited magnetic particles are electrically conductive, the magnetic particles are difficult to transfer to a transfer sheet. The result is that the image density of the transferred images is decreased. In the present invention, the saturation magnetic moment was measured by a commercially available sample-vibration-type magnetometer (VSM-3 Type made by Toeikogyo Co., Ltd.), under application of a magnetic field of 5 KOe.

The electroconductive magnetic particles for use in the developer according to the present invention are made of magnetizable materials, for example, metals, alloys and metal oxides of Fe, Ni, Co and Mn, such as magnetite ($Fe_3O_4$), $\gamma$-hematite ($\gamma$-$Fe_2O_3$) and ferrites (for example, Zn ferrite and Mn ferrite).

By referring to the following examples, the present invention will now be explained in more detail.

EXAMPLE 1

[Preparation of Magnetic Toner Particles]

A mixture of the following components was kneaded under application of heat thereto by heat rollers:

| | Parts by Weight |
|---|---|
| Styrene - n-Butyl methacrylate copolymer | 100 |
| Carbon black | 2 |
| Orient Spirit Black AB (made by Orient Chemical Industries, Ltd.) | 2 |
| Magnetite (0.2 μm) | 50 |

After the kneaded mixture was cooled, it was ground to finely-divided particles and was then classified, whereby magnetic toner particles having a volume mean diameter of 20 μm, a volume resistivity of $5\times10^{14}$ Ωcm and a saturation magnetic moment of 29 emu/g for use in the present invention was obtained.

[Preparation of Electroconductive Magnetic Particles]

Finely-divided zinc ferrite particles having a volume mean diameter of 7 μm were subjected to heat treatment at 250° C. for 1 hour, so that electroconductive magnetic particles having a volume mean diameter of 7 μm, a volume resistivity of $9\times10^{8}$ Ωcm and a saturation magnetic moment of 53 emu/g were prepared.

[Preparation of Developer No. 1]

75 parts by weight of the magnetic toner particles, 25 parts by weight of the electroconductive magnetic particles and 0.5 parts by weight of titanium oxide powder were mixed, so that a developer No. 1 according to the present invention was prepared.

Figure 2:
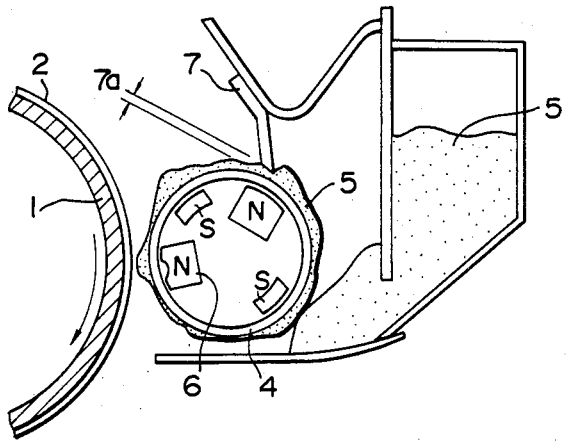
FIG. 2 is a schematic partial cross-sectional view of a photographic copying apparatus using the developer according to the present invention.

A latent electrostatic image with a negative polarity was formed on an organic photoconductor by a conventional electrophotographic method. The thus formed latent electrostatic image was developed to a visible toner image with the above prepared developer No. 1 by a development apparatus including a development sleeve made of aluminum as illustrated in FIG. 2. The toner image was then transferred to a sheet of plain paper under application of positive charges and was then fixed to the paper under application of heat. 100,000 copies were continuously made in this manner. The result was that clear images free from white spots or band-like shaped undeveloped areas were obtained during the course of this running test.

EXAMPLE 2

[Preparation of Magnetic Toner Particles]

A mixture of the following components was kneaded under application of heat thereto by heat rollers:

| | Parts by Weight |
|---|---|
| Piccolastic D-125 (polystyrene, made by Esso Sekiyu K.K.) | 100 |
| Spilon Black TOH (made by Hodogaya Chemical Co., Ltd.) | 1 |
| Magnetite (0.2 μm) | 100 |

After the kneaded mixture was cooled, it was ground to finely-divided particles and was then classified, whereby magnetic toner particles having a volume mean diameter of 12 μm, a volume resistivity of $3\times10^{13}$ Ωcm and a saturation magnetic moment of 43 emu/g for use in the present invention was obtained.

[Preparation of Electroconductive Magnetic Particles]

Finely-divided magnetite particles having a volume mean diameter of 6 μm were subjected to heat treatment at 250° C. for 30 minutes, so that electroconductive magnetic particles having a volume mean diameter of 6 μm, a volume resistivity of $6\times10^{8}$ Ωcm and a saturation magnetic moment of 65 emu/g were prepared.

[Preparation of Developer No. 2]

70 parts by weight of the magnetic toner particles, 30 parts by weight of the electroconductive magnetic particles and 1.5 parts by weight of alumina white particles having an average particle size of 0.1 μm were mixed, so that a developer No. 2 according to the present invention was prepared.

A latent electrostatic image with a positive polarity was formed on a selenium photoconductor by a conventional electrophotographic method. The thus formed latent electrostatic image was developed to a visible toner image with the above prepared developer No. 2 by the same development apparatus as that employed in Example 1. The toner image was then transferred to a sheet of plain paper under application of negative charges and was then fixed to the paper under application of heat. 200,000 copies were continuously made in this manner. The result was that clear images free from white spots or band-like shaped undeveloped areas were obtained during the course of this running test.

EXAMPLE 3

[Preparation of Magnetic Toner Particles]

A mixture of the following components was kneaded under application of heat thereto by heat rollers:

| | Parts by Weight |
|---|---|
| Styrene - Methyl methacrylate copolymer | 100 |
| Nigrosin | 2 |
| Magnetite (0.1 μm) | 120 |

After the kneaded mixture was cooled, it was ground to finely-divided particles and was then classified, whereby magnetic toner particles having a volume mean diameter of 15 μm, a volume resistivity of $8\times10^{12}$ Ωcm and a saturation magnetic moment of 50 emu/g for use in the present invention was obtained.

[Preparation of Developer No. 3]

85 parts by weight of the magnetic toner particles, 30 parts by weight of electroconductive magnetic particles consisting of maghemite particles having a volume mean diameter of 4 μm, a volume resistivity of $5\times10^{8}$ Ωcm and a saturation magnetic moment of 73 emu/g, and 0.3 parts by weight of hydrophobic silica particles (R 972 made by Nippon Aerosil Co., Ltd.) were mixed, whereby a developer No. 3 according to the present invention was prepared.

A latent electrostatic image with a negative polarity was formed on the same organic photoconductor as that employed in Example 1 and was then developed to a visible toner image with the above prepared developer No. 3 by the same development apparatus as that employed in Example 1. The toner image was then transferred to a sheet of plain paper under application of negative charges and was then fixed to the paper under application of heat. 150,000 copies were continuously made in this manner. The result was that clear images free from white spots or bank-like shaped undeveloped areas were obtained during the course of this running test.

COMPARATIVE EXAMPLE 1

75 parts by weight of the magnetic toner particles prepared in Example 2, 25 parts by weight of magnetite particles having an average particle size of 6 μm, a volume resistivity of $5\times10^{5}$ Ωcm and a saturation magnetic moment of 85 emu/g and 1.5 parts by weight of alumina white having an average particle size of 0.1 μm were mixed, whereby a comparative developer No. 1 was prepared.

The thus prepared comparative developer No. 1 was subjected to the same copy test as in Example 2. The result was that the images were initially clear and free from toner deposition on the background, but when the total copy number exceeded about 20,000, white spots appeared in the images and when the copy number exceeded 50,000, band-shaped white areas appeared in the images.

COMPARATIVE EXAMPLE 2

[Preparation of Electroconductive Magnetic Particles]

A mixture of the following components was kneaded under application of heat:

| | Parts by Weight |
|---|---|
| Piccolastic D-125 | 100 |
| Magnetite | 50 |
| Carbon black | 10 |

The mixture was then cooled and ground to finely-divided particles and the particles were classified, whereby comparative electroconductive magnetic particles having a volume mean diameter of 5 μm, an electric resistivity of $2\times10^{6}$ Ωcm and a saturation magnetic moment of 27 emu/g were prepared.

80 parts by weight of the magnetic toner particles prepared in Example 3, 20 parts by weight of the electroconductive magnetic particles and 1 part by weight of titanium oxide were mixed, whereby a comparative developer No. 2 was prepared.

The thus prepared comparative developer No. 2 was subjected to the same copy test as in Example 3. The result was that the image density obtained was as low as 0.8 from the beginning and was not suitable for use in practice. The image density was measured by a Macbeth densitomer RD-514.

According to the present invention, there can be provided a developer which is excellent in development performance and image transfer performance, capable of yielding images having high image density with clear background free from toner deposition. Furthermore, according to the present invention, the magnetic coagulation of the electroconductive magnetic particles is not caused, so that uneven distribution of the electroconductive magnetic particles in the developer is avoided, thereby preventing the formation of undeveloped white spots or band-like shaped areas in the images to be developed.

What is claimed is:

1. A developer comprising a mixture of (a) magnetic toner particles comprising a polymeric material and finely-divided magnetic particles, having an electric resistivity of $10^{12}$ Ωcm or more, and (b) electroconductive magnetic particles having an electric resistivity of $10^{9}$ Ωcm or less, a smaller volume mean diameter than that of said magnetic toner particles, with the saturation magnetic moment of the electroconductive magnetic particles being in the range of from 25 emu/g to 75 emu/g, which is larger than the saturation magnetic moment of said magnetic toner particles.

2. The developer as claimed in claim 1, wherein the volume mean diameter of said electroconductive magnetic particles is in the range of from 1/5 to 4/5 the volume mean diameter of said magnetic toner particles.

3. The developer as claimed in claim 1, wherein said polymeric material included in said magnetic toner particles is selected from the group consisting of styrene-type resin, acrylic resin, vinyl-type resin, epoxy resin, polyester resin, phenolic resin, polyurethane resin, natural resin and celluloses.

4. The developer as claimed in claim 1, wherein said finely-divided magnetic particles included in said magnetic toner particles are selected from the group consisting of magnetizable particles of metals, metal oxides and alloys, having a particle size of 1 μm or less.

5. The developer as claimed in claim 1, wherein said magnetic toner particles further comprising a colorant selected from the group consisting of carbon black, Aniline Black, Crystal Violet, Rhodamine B, Malachite Green, Nigrosin, copper phthalocyanines and azo dyes.

6. The developer as claimed in claim 1, wherein said magnetic toner particles further comprises a polarity control agent selected from the group consisting of Nigrosin, mono-azo dyes, zinc hexadecyl succinate, alkyl esters of naphthoic acid, alkylamides of nathphtoic acid, nitrohumic acid, N,N'-tetramethyldiamine benzophenone, N, N'-tetrabenzidine, triazine and salicylic acid metal complexes.

7. The developer as claimed in claim 1, wherein the volume mean diameter of said electroconductive magnetic particles is within the range of from 3/10 to $\frac{2}{3}$ the volume mean diameter of said magnetic toner particles.

8. The developer as claimed in claim 1, wherein the volume resistivity of said electroconductive magnetic particles ranges up to $10^9$ Ωcm and the volume resistivity of the magnetic powder particles is at least $10^{12}$ Ωcm.

9. The developer as claimed in claim 1, wherein the relative amounts of said magnetic toner particles to said electroconductive magnetic particles ranges from a composition of the two particles of 70 parts by weight of the magnetic toner particles with 30 parts by weight of the electroconductive magnetic particles to a composition comprising 85 parts by weight of the magnetic toner particles with 30 parts by weight of the electoconductive magnetic particles.

10. A developer comprising a mixture of (a) magnetic toner particles comprising a polymeric material and finely-divided magnetic particles which have an electric resistivity of at least $10^{12}$ Ωcm, and (b) electroconductive magnetic particles having an electric resistivity of up to $10^9$ Ωcm and a saturation magnetic moment ranging from 25 emu/g to 75 emu/g, which is larger than the saturation magnetic moment of said magnetic toner particles (b), and the volume mean diameter of said electroconductive magnetic particles (b) being within the range of from 1/5 to 4/5 the volume mean diameter of said magnetic toner particles (a).

* * * * *